United States Patent [19]

Eickmann

[11] 3,975,988

[45] Aug. 24, 1976

[54] RADIAL PISTON MACHINE WITH PIVOTED CONNECTION BETWEEN PISTON AND PISTON SHOES

[76] Inventor: Karl Eickmann, 2420 Isshiki, Hayama, Kanagawa, Japan

[22] Filed: Sept. 25, 1975

[21] Appl. No.: 616,846

Related U.S. Application Data

[60] Continuation of Ser. No. 454,794, March 26, 1974, abandoned, which is a division of Ser. No. 202,516, Nov. 26, 1971, Pat. No. 3,803,986, which is a division of Ser. No. 830,246, June 4, 1969, Pat. No. 3,697,201.

[30] Foreign Application Priority Data

Jan. 31, 1968 United Kingdom ..... 4930/68

[52] U.S. Cl. ..... 91/492

[51] Int. Cl.[2] ..... F01B 13/06

[58] Field of Search ..... 91/491, 492, 497, 498

[56] References Cited

UNITED STATES PATENTS

| | | | |
|---|---|---|---|
| 1,987,781 | 1/1935 | Maw | 91/498 |
| 2,099,630 | 11/1937 | Schneider | 91/498 |
| 2,496,915 | 2/1950 | Hoffer | 91/492 |
| 2,698,585 | 1/1955 | Cotner et al. | 91/491 |
| 2,741,993 | 4/1956 | Orshansky | 91/497 |
| 3,225,701 | 12/1965 | Griffith | 91/488 |
| 3,270,685 | 9/1966 | Eickmann | 91/492 |
| 3,357,362 | 12/1967 | Orr | 91/492 |

FOREIGN PATENTS OR APPLICATIONS

| | | | |
|---|---|---|---|
| 1,254,200 | 1/1961 | France | 91/498 |

*Primary Examiner*—John J. Vrablik
*Attorney, Agent, or Firm*—Michael J. Striker

[57] ABSTRACT

A fluid-handling machine has a housing and radial cylinder blocks mounted for rotation in the same. Radially movable pistons are mounted in the cylinder blocks and each have an end portion formed with an elongated head of part-cylindrical cross section which is joined to the associated end portion by a constricted neck. The longitudinal axis of the respective neck extends normal to the longitudinal axis of the associated piston. Piston shoes are associated with the pistons and are formed with respective part-cylindrical recesses in each of which one of the heads is seated and retained, whereas the necks are located outside the recesses.

10 Claims, 3 Drawing Figures

RADIAL PISTON MACHINE WITH PIVOTED CONNECTION BETWEEN PISTON AND PISTON SHOES

This is a continuation of application Ser. No. 454,794, filed Mar. 26, 1974, now abandoned, which is a division of Ser. No. 202,516, filed Nov. 26, 1971, now U.S. Pat. No. 3,803,986, which is a division of Ser. 830,246, filed June 4, 1969, now U.S. Pat. No. 3,697,201.

CROSS REFERENCE TO RELATED APPLICATION

This is a division of my application Ser. No. 202,516, filed on Nov. 26, 1971 and currently copending, which in turn is a division of application 830,246.

BACKGROUND OF THE INVENTION

In rotary fluid handling devices with radially variable working chambers, like gear pumps, vane pumps, trochoid pumps, radial piston pumps, machines or motors, for example of the type disclosed in U.S. Pat. No. 3,470,825, it was difficult heretofore to fasten the fluid handling rotary members on the driving or driven shaft of the machine, because fastening means, like keyways or splines would disturb the control face portion or cause the necessity of larger inner diameters of the control faces, which in turn would then cause greater control faces and thereby greater friction between control faces of the machine. These drawbacks restricted the efficiency of such machines and their power. One of the worst difficulties in heretofore known fluid-handling devices was that the shaft deformed under the heavy radial load and that rotary control faces were not entirely parallel to and floating adjacent the stationary control faces of the devices. This resulted in wearing and friction at certain portions of the control clearances and in high leakage at higher pressures at other portions of the control clearances on the axial ends of the fluid handling rotary members.

SUMMARY OF THE INVENTION

It is the main object of this invention to overcome those drawbacks.

The object of this invention is met by the invention in that a shaft bears at least two rotary members thereon, whereof at least one is a fluid handling-body sliding with a rotary control face along a stationary control face of a cover of the machine or a member thereof and defining therewith the control clearance between said control faces. The shaft is provided with a median bearing portion of a bigger diameter for bearing the said rotary members thereon, and on the ends of the median bearing portion clutching means are provided on smaller diameter portions of said shaft for clutching or coupling the rotor members to said shaft. The rotor members are provided with respective clutch portions or coupling portions radially inward of the rotary control faces of said rotary members for association with said clutching or coupling members or portions of said shaft. Thus, the rotary members are moved lengthwise of the shaft from the axial ends thereof, clutch into the clutching portions and are entrained thereby for rotation in unison with the shaft.

The clutching or coupling means allow an axial movement of the rotary members relatively to the shaft, so that the rotary members can easily engage the stationary control faces of the device.

In keeping with another object of the invention, the rotary members of the device are inserted and kept between two innermost control faces of cover means of the device, thereby forming close clearances between the end faces of the rotary members and the said innermost control faces. The bearing portions of the shaft are so configurated that radial deflection of the shaft is prevented and a small spherical movement of the rotary members is assured, while a definite axial freedom of movement of the rotary members is maintained. The rotary control faces of the rotary members are therefore able, due to the invention, to slide tightly along the stationary control faces of the device with less friction and to seal thereagainst.

The provision of the larger-diameter median bearing portion on the shaft realizes another object of the invention, which is to prevent deflection of the shaft and resulting inclination of the rotary members and their rotary control faces.

Another object of the invention, which is to provide the smallest possible rotary and stationary control faces for assuring little leakage and little friction therebetween, to thereby increase the volumetric and total efficiency of the machine, is realized in that the clutching or coupling portions or members of the invention are made of smaller diameter than the median bearing portion of the shaft, so that control faces of small diameters can be formed adjacent the said clutching or coupling means or members.

A still further object of the invention is to provide a fluid-handling device which is easy to manufacture and inexpensive in production but at the same time avoids the need for additional universal joint type mounting means. This object is achieved in that key means constitute the clutching or coupling means of the shaft and rotary members. Such key means are spline means because they are easy to manufacture and, since they are integral with the shaft or the rotary members, cannot disassemble and fall off.

Another object of the invention is to provide piston shoe seats in pistons of a simple configuration, and piston shoes with piston shoe seats which embrace the piston shoe seat of the associated piston and which allow a pivoting of the piston shoe relative to the piston, while at the same time an axial moveability between the pistons and piston shoes is assured. Guide means may be added or associated to the piston shoes in order to guide their movement or in order to actuate their and the pistons' radial movements. According to this object of the invention, the piston head is formed partcylindrical with an axis normal to the axis of the piston and the piston shoe embraces the piston head over more than 180 degrees, so that the piston shoe can not fall off from the associated piston.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
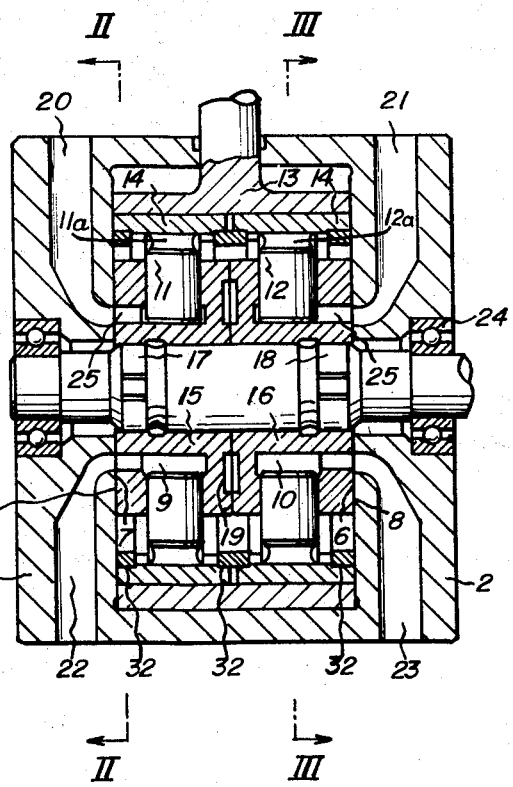
FIG. 1 is a longitudinal sectional view through a preferred embodiment of the invention.
Figure 2:
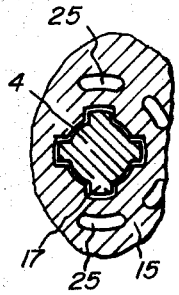
FIG. 2 is a fragmentary cross-sectional view through FIG. 1 along the line II—II.
Figure 3:
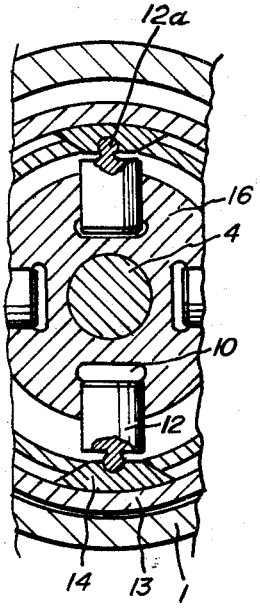
FIG. 3 is a fragmentary cross-sectional view through FIG. 1 along the line III—III.

In FIGS. 1 to 3, numeral 1 designates the housing and numerals 2 and 3 show the covers of the housing of the machine according to the invention. Control faces 5 and 6 are provided inwardly on the respective covers 2 and 3. These control faces are the stationary control faces. Fluid passages 20 and 22 extend through cover 3 and form control ports therein which extend through control face 5, while fluid passages 21 and 23 extend through cover 2 and form control ports therein which extend through control face 6. In the covers 2 and 3 bearings 24 are provided wherein the driving or driven shaft 4 is rotatably journalled. Shaft 4 is provided with entraining means in form of a key or spline 17 on one portion of shaft 4 and with a respective other entraining means 18 on another portion of shaft 4. Entraining means in this case shall mean that the entraining means entrains one or more members for rotation in unison with shaft 4, or vice versa. Between the entraining means 17 and 18 is located a larger-diameter portion of shaft 4 which is preferably circular for bearing respective rotor members or piston blocks 15 and 16 thereon. According to the invention, there is not one rotor, but there are two rotor members 15 and 16. Each member 15 and 16 is provided with a hub which forms a seat suitable to be supported on the median portion of shaft 4 and endwards of the respective hub there is provided a coupling portion which mates with the entraining means 17 or 18, respectively. The members 15 and 16 are moved axially of the shaft 4 until each member 15 or 16 engages with the entraining means 17 or 18 and is supported on the median portion of the shaft 4 between the entraining means 17 and 18. Members 15 and 16 are now in abutment with one another and one or more spaces may be formed between them, for example as shown by numeral 19. The axially outer ends of members 15 and 16 are provided with respective plane or otherwise, for example, conical or spherical end faces 7 and 8, which constitute rotary control faces. Said rotary control faces are each juxtaposed with and slide along the neighboring stationary control face, for example rotary control face 7 along stationary control face 5 and rotary control face 8 along the stationary control face 6. Member 15 is provided with working chambers 9, whereto the rotor passages 25 lead. Rotor passages 25 each extend from a respective working chamber in the respective member 15 or 16 through a portion thereof into and through the respective rotary control face 7 or 8. Displacement elements 11 are provided in the working chambers 9 of member 15 and displacement elements 12 are provided in member 16. The displacement elements 11 and 12 are in this embodiment of the invention provided with displacement guide shoes 14. Displacement actuator means 13 is provided for guiding the displacement guide shoes and thereby the displacement elements 11 and 12 inwardly and outwardly of the respective working chambers 9 or 10. Thus, fluid is suctioned into working chambers 9 through passage 20 or 22 and the respective control ports and rotor passages 25, when the displacement elements move outward in chambers 9, and the fluid is expelled from said chambers 9 in the opposite flow direction when the displacement elements 11 move inwards in the working chambers 9.

Fluid is taken into working chambers 10 when displacement elements 12 move outwards in said chambers 10 through passage 21 or 23 and the respective control port thereof and through the respective rotor passage 25, and fluid is expelled out of the respective working chamber 10 when the respective displacement element 12 moves inwards in said respective chamber or chambers. The flow direction is thereby reversed. Thrust means, fluid-containing chambers or other chambers, springs or the like, which are designated by numeral 19 may be provided between the members 15 and 16 and or extend into one or both of them. The thickness of the members 15 and 16 in axial direction is preferably so dimensioned that the members 15 and 16, if in abutment with each other at their adjacent end faces, just fit with a suitable clearance for operation between the stationary control faces 5 and 6 of housing covers 2 and 3. The members 15 and 16 are axially movable relative to shaft 4, but are prevented from relative rotational movement with reference to shaft 4. They therefore revolve in unison with shaft 4, while they can axially move for reduced-friction floating with their end faces, i.e., the rotary control faces 7 and 8 between the stationary control faces 5 and 6. The latter stationary control faces may also be provided on separate control bodies, if they are not directly provided on the covers 2 or 3. If the distance between the stationary control faces 5 and 6 is larger than the axial thicknesses of the members 15 and 16, then the thrust means 19 between rotor members 15 and 16 are provided for pressing the respective members 15 or 16 in axially outward direction to obtain close engagement of the rotary control faces 7 and 8 with the stationary control faces 5 and 6. This is possible because of the axial moveability of both members 15 and 16. Leakage between the control faces 5 and 7 and 6 and 8 is thereby reduced to a minimum and thrusts or vibration of blows onto shaft 4 from outside are not transferred from the shaft 4 to the members 15, 16, because the latter are axially movable on the shaft 4. At the same time, the thicker portion of shaft 4 between the entraining means 7 and 8 provides large radial bearing force for bearing the highly loaded members 15 and 16 strongly on shaft 4. Thus, the machine of the embodiment of FIGS. 1 to 3 is a fluid-handling device, for example, pump or rotor, of high pressure capability, high reliability, simplicity and safety, which prevents friction between its stationary and rotary control faces.

The pistons of the radial piston type fluid-handling device of FIGS. 2 and 3 are provided with piston heads for connection of the piston, shoes 14 which are pivotable to the pistons. The piston heads 11*a* and 12*a* of pistons 11 and 12 are formed part-cylindrical around an axis normal to the axis of the piston. The part-cylindrical configuration extends with equal radius around the axis of the piston head for more than 180°, so that a narrow piston neck is formed between the piston and the piston head. The said piston neck is narrower than the piston head, because the part-cylindrical configuration extends more than 180°. The piston shoes 14 have a piston shoe seat which is formed corresponding to the piston head for embracing the piston head over more than 180°. The axis of the piston shoe seat is the same as that of the respective piston head. Said axes are parallel to the axis of the rotor and shaft of the device. An only very small clearance is foamed between the piston shoe seat and the piston head, so that the piston shoe can pivot around the piston head axis in the desired extent. The piston neck is narrowed for allowing the piston shoe to pivot to the desired extent.

Guide rings 32 may be associated to the piston shoes 14 for guiding the same. The piston shoes 14 and guide rings 32 may be provided with guide faces for guiding the radial outward movement of the piston shoes, thereby also entraining the pistons 11 and 12 in outward direction. The guide rings 32 and piston shoes 14 may also have further guide faces for preventing the piston shoes from undesired axial displacement.

This piston-piston shoe arrangement is easy to manufacture and reliable in operation, because it allows pivotable and axial freedom of the piston shoes 14 and at the same time assures that the pistons 11 or 12 and the respective piston shoe 14 remain connected together at all times.

It will be understood that each of the elements described above, or two or more together, may also find a useful application in other types of constructions differing from the type described above.

While the invention has been illustrated and described as embodied in a fluid-handling machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. In a radial piston machine, a combination comprising a housing including a first pair of planar end faces; rotor means mounted in said housing and including a second pair of planar end faces; end covers at opposite axial ends of said housing and including a third pair of planar end faces inwardly directed and which form with said rotor means and said housing an annular clearance; an axial shaft supported for rotation in bearings in said end covers; said rotor means including a pair of rotors carried by said axial shaft and each having one of the said second pair of planar end faces and each including another planar end face and adapted to abut each other; entraining means for each said rotors for coupling thereof to said axial shaft for rotation therewith but permitting axial movement therealong, said first and third planar end faces, facing and cooperating with said second planar end faces to define said annular clearance thereby coacting with said entraining means to permit said rotors to rotate in unison while permitting said axial movement relative to said shaft, thrust means for said rotors for pressing said rotors in an axially outward direction to obtain close engagement between the facing planar end faces, thereby reducing leakage from between the facing planar end faces while preventing friction therebetween; fluid ports in at least one of said end covers; a radial movable piston in each said rotors, each said piston including an outer end portion comprising a part-cylindrical head and a constricted neck; and piston shoes positioned in said annular clearance and embracing solely said heads in full mating relationship over an extent of more than 180°, said constricted neck being free to permit said piston shoe to pivot; said piston shoes each including two guide faces spaced axially of said rotors and each facing towards one of said end covers, at least one of said guide faces of each piston shoe being guided by said inner face of one of said end covers.

2. In a machine as claimed in claim 1, wherein each said piston and said piston shoe is arranged in a group, one for each said rotors and positioned in juxtaposition to each longitudinally of the axes of said shaft, said axis of each said piston head being parallel to the axes of said shaft; and wherein said piston shoes include further guide faces, said further guide faces of each piston shoe abutting each other for preventing the piston shoes from undesired axial displacement.

3. In a machine as claimed in claim 1, wherein each said piston and said piston shoe is arranged in a group, one for each said rotors and positioned in adjacent relationship to each other longitudinally of the axes of said shaft, said axes of each said piston head being parallel to the axes of said shaft; and including guide rings associated with said piston shoes, said guide rings including guide faces which together with said guide faces of said piston shoes guide the radial outward movement of said piston shoes whereby to entrain said pistons in an outward direction.

4. In a machine as claimed in claim 1, wherein said thrust means includes fluid-containing chambers between said rotors.

5. In a machine as claimed in claim 1, wherein said thrust means includes a fluid-containing chamber extending into one of the abetting faces between said rotors.

6. In a machine as claimed in claim 1, wherein each of said part-cylindrical head has a longitudinal axis parallel to the axes of said axial shaft.

7. In a machine as claimed in claim 1, and further comprising guide ring means operatively associated with said piston shoes for guiding the outward radial movement of said piston shoes.

8. In a machine as claimed in claim 1, and further comprising guide ring means associated with said piston shoes and operative for guiding said piston shoes and preventing undesired axial displacement of the same.

9. In a machine as claimed in claim 1, wherein said piston shoes have recesses dimensioned to embrace the respectively associated heads in the said full mating relationship over said distance greater than said 180° of arc, said part-cylindrical configuration extending with equal radius around the axes of said piston head for more than said 180° of arc, said constricted neck being exposed whereby to provide for said free movement of said piston shoe.

10. In a machine as claimed in claim 1, wherein said entraining means includes clutching and comprises means to spline said rotors onto said axial shaft to permit said axial movement of said rotors on said shaft, and wherein said piston shoes include recesses dimensioned to embrace the respectively associated heads over said distance greater than said 180° while permitting said constricted neck to be exposed, thereby allowing a pivoting of the piston shoe relative to the piston, while at the same time assuring axial moveability between the pistons and the piston shoes.

* * * * *